US006701836B2

(12) United States Patent
Sommer

(10) Patent No.: US 6,701,836 B2
(45) Date of Patent: Mar. 9, 2004

(54) PRINTING-MACHINE DRIVE SYSTEM

(75) Inventor: Eckehard Sommer, Dielheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/096,463

(22) Filed: Mar. 12, 2002

(65) Prior Publication Data

US 2002/0124743 A1 Sep. 12, 2002

(30) Foreign Application Priority Data

Mar. 12, 2001 (DE) ..... 101 11 647

(51) Int. Cl.[7] ..... B41L 19/00
(52) U.S. Cl. ..... 101/183; 101/484; 101/485
(58) Field of Search ..... 101/183, 484, 101/216, 485; 318/65

(56) References Cited

U.S. PATENT DOCUMENTS

| | | | | | |
|---|---|---|---|---|---|
| 4,899,653 | A | * | 2/1990 | Michl et al. | 101/148 |
| 5,263,413 | A | * | 11/1993 | Ikeguchi | 101/183 |
| 5,615,609 | A | | 4/1997 | Hill et al. | |
| 5,826,505 | A | * | 10/1998 | Volz et al. | 101/183 |
| 6,095,043 | A | * | 8/2000 | Hartmann et al. | 101/183 |
| 6,343,549 | B1 | * | 2/2002 | Tokiwa | 101/248 |
| 6,354,214 | B1 | * | 3/2002 | Tokiwa | 101/484 |
| 6,526,889 | B2 | * | 3/2003 | Tokiwa | 101/485 |
| 2001/0018872 | A1 | * | 9/2001 | Tokiwa | 101/221 |

FOREIGN PATENT DOCUMENTS

| | | | |
|---|---|---|---|
| DE | 43 22 744 C2 | 8/1998 | |
| EP | 0 753 405 A1 * | 1/1997 | ..... B41F/13/004 |

OTHER PUBLICATIONS

Philipp, W.: "Digitale Antriebe und SERCOS interface" [Digital Drives and SERCOS Interface], Antriebstechnik 31, No 12, 1992, pp. 120–123.

Fischer, H.: "Antriebstechnik setzt auf Profibus" [Drive Engineering Bets on Profibus], TR Technische Rundschau, vol. 33, 1992, pp. 42–44.

* cited by examiner

*Primary Examiner*—Charles H. Nolan, Jr.
(74) *Attorney, Agent, or Firm*—Laurence A. Greenberg; Werner H. Stemer; Gregory L. Mayback

(57) ABSTRACT

A method of synchronizing a printing-machine drive system having a plurality of drives with drive motors, includes assigning to the drives local drive control units and a central operating and control unit with a data processing system having components connected to communicate with one another. The drive motors are operated decentrally by prescribed drive data via the respectively assigned drive control units. Respective drive data are calculated, with at least one of the components of the data processing system of one of the drive control units, in dependence on computing operations required in other components of the data processing system. System-induced differences between the drives or system-induced differences between the components of the data processing system are compensated, in a resulting calculation. A printing machine is also provided for performing the method.

20 Claims, 1 Drawing Sheet

PRINTING-MACHINE DRIVE SYSTEM

BACKGROUND OF THE INVENTION

Field of the Invention

The invention relates to a method of synchronizing a printing-machine drive system having a plurality of drives with drive motors, to which local drive control units and a central operating and control unit with a data processing system are assigned, components of the data processing system being connected so as to communicate with one another, and the drive motors being operated decentrally via the respectively assigned drive control units by prescribed drive data. The invention also relates to a printing machine for implementing the foregoing method.

A method for driving a plurality of motors of a drive system, which serves for keeping the motors synchronized, has become known heretofore. In general, such drive systems are subject to a problem of keeping a relatively large number of drives synchronized with regard to the prescription of a nominal or desired angular value. In particular, in the case of a drive system of a printing machine with drives for each printing stage and printing ink, respectively, it is necessary to keep the drive motors of the various drives synchronized in order to be able to realize good printed results. Because of the different specifications of the drives, in the printing machine, it must first be possible for various types of drive motors to be used in the drives and, secondly, it is necessary to provide various types of processors for the drive controls of the drives.

U.S. Pat. No. 5,615,609 describes a drive system and a method of controlling the data acquisition in a printing machine for corrugated board, having a plurality of drives which permit the use of d.c.-motors. In this regard, a main drive control for controlling the motor speed is coupled electronically with the main drive. A main drive timing or clock generator generates an output clock which depends upon the rotational movement of the main drive. A follower drive motor is coupled electronically with a follower drive control in order to control the speed of the follower drive motor with respect to the main drive motor. A follower drive clock generator generates an output clock as a function of the rotational movement of the follower drive of the printing machine. A controller is set up to receive the output clock signals from the main and the follower drive clocks, and processes the main and the follower drive clocks in order, in this respect, to generate control commands and transmit them to the follower drive control, so that the follower drives are set as a function of the main drive, in order to achieve synchronous running of the main and the follower drive motors.

The disadvantages of this system and method consist primarily in that the controls of the follower drives depend upon the operation of the main drive. This dependence calls for the running of the follower drives always to react with a delay to the prescription of the main drive. Differences between the clock generators and also in computing accuracy and computing speed of the drive controls cannot be compensated for internally. Furthermore, the synchronous running of the drive motors is set exclusively based upon the clock signals from the clock generators assigned to the motors, so that relatively large differences between the operating values of the d.c.-motors and the desired values of the central control, which exceed one or more sampling intervals, cannot be corrected by the heretofore known synchronous control.

A further disadvantage is that the transmission of the main drive clock to the follower drive controls takes place over electronic paths of different lengths, generally with one or more electronic modules being interposed, so that different transmission times also occur. Compensation for such differences in an electronic conductor arrangement which is physically extended and exposed to interference is costly and susceptible to error.

It is also disadvantageous that, when various types of drive motors are used on the printing machine and are controlled with different processors, the processors can have different clock frequencies, different computing accuracies with regard to the number of decimal places and roundings, respectively, and different sampling times, at which the motor positions are checked. When these various types of drive motors interact with different processors, after a given time, a drift in the synchronous running of the drive motors is produced, which is set due to the aforedescribed differences in the components, and effects an angular difference of the drive motors, which cannot be detected by the drive control itself. Even if this angular difference should not actually lead to collisions between mechanical parts, it nevertheless causes considerable loss in terms of quality in the print.

Furthermore, from interface technology, drive controls for machine drives have become known heretofore wherein the data processing systems of the drives are connected together in data loops. The company periodical SERCOS-IEC61491, EN 61491 discloses a drive system wherein, respectively, a plurality of drive axes can be connected together in a data loop as a drive group. In each data loop, the prescription of drive values and control commands is updated in a sampling and updating cycle successively in each of the connected drives, which means that the updating of the desired or nominal values of each drive is carried out almost simultaneously by processing the same command, test and computing steps.

In this system, it has proven to be disadvantageous for a large amount of data to be produced between the drives and the control units thereof, and also between the drive control units and the central operating and control unit, because, due to the accuracy requirement with regard to synchronous running, in particular when used in a printing machine having a plurality of drives, the values have to be measured simultaneously in each individual drive, and the command prescriptions thereof have to be processed simultaneously. In the disclosed data loops, therefore, complicated and costly components are needed for the corresponding data connections, such as the data bus between the control units, and corresponding integrated circuits with a high capacity.

Furthermore, in this system, it is disadvantageous that the processing of a command and/or sampling cycle is successively performed from drive to drive and can therefore vary in time between the drive groups, respectively, connected in separate data loops. Only after a cycle has been completed are all the drives in the data loop coordinated synchronously with one another, the coordination of the data loops of the various drive groups having to be performed centrally.

In order to avoid inaccuracies or disruption of the synchronous running in all of the drives, there is therefore a need for costly data processing systems, including the data processing programs provided for this purpose, which can manage the large throughput of data and take into account the required, extremely low cycle and sampling times, respectively.

SUMMARY OF THE INVENTION

Consequently, it is an object of the invention to improve the synchronization of a plurality of drive motors of a printing-machine drive system, or the like.

With the foregoing and other objects in view, there is provided, in accordance with one aspect of the invention, a a method of synchronizing a printing-machine drive system having a plurality of drives with drive motors, to which local drive control units and a central operating and control unit with a data processing system are assigned, components of the data processing system being connected so as to communicate with one another, and the drive motors being operated decentrally by prescribed drive data via the respectively assigned drive control units, which comprises, calculating, with at least one component of the data processing system of one of the drive control units, respective drive data as a function of the computing operations required in the remaining components of the data processing system, and, in a resulting calculation, compensating for system-induced differences between at least one of the drives and the data processing system.

In accordance with another mode, the method of the invention further comprises providing nominal values for the drive data for each of the drives, and centrally calculating the nominal values by a nominal value generator.

In accordance with a further mode, the method further comprises providing the drive data as at least one of the values selected from the group thereof consisting of a position, speed and acceleration of the drive motor.

In accordance with an added mode, the method further comprises providing the compensation in the calculation for differences in at least one of clock rate, computing time and computing accuracy of electronic components of drive controls.

In accordance with an additional mode of the method of the invention, the components of the controls are selected from the group consisting of processors and memory units.

In accordance with yet another mode, the method of the invention further comprises, by the central operating and control unit, transmitting nominal values for the drive of the drive system to the drive control units, by the respective components of the data processing system of the drive control units, calculating the respective drive data of the respectively assigned drive, and, by the data processing system, performing equivalent operations in order to calculate the respective drive data.

In accordance with yet a further mode, the method of the invention further comprises, in order to synchronize the drives, decentrally registering the operating values of each drive motor by the assigned local drive control unit, and calculating, by the data processing system, deviations of the operating values from the nominal values prescribed by the central operating and control unit, and adapting the drive values to compensate therefor.

In accordance with yet an added mode of the method invention, the deviations of the operating values from the nominal values calculated by the data processing system are angular differences between the drive motors.

In accordance with yet an additional mode, the method of the invention further comprises providing at least one of the operations necessary for calculating and adapting the drive data of a drive by at least one of prescribing it and determining it directly by an interlocking connection in a data network by the data processing system.

In accordance with still another mode, the method of the invention further comprises distributing and comparing information about necessary operations of the data processing system in the data network, determining the minimally required identical operations in the data network, and modifying the operations required for each component of the data processing system for at least one of calculating and adapting the drive data in a manner that, for each drive, the minimally required operations are performed during the calculation.

In accordance with still a further mode, the method of the invention further comprises determining at least one of the necessary and the minimally required operations, respectively, by at least one of the components of the data processing system of at least one of the assigned drives and the central operating and control unit.

In accordance with still an added mode, the method of the invention further comprises providing the operations as at least one set of steps selected from the groups thereof consisting of storage steps and computing steps.

In accordance with still an additional mode of the method of the invention, the computing steps are selected from the groups consisting of additions and multiplications.

In accordance with another mode, the method of the invention further comprises performing the same number of steps selected from the groups thereof consisting of computing steps and storage steps by the component of the data processing system of each drive in order to calculate the drive data.

In accordance with a further mode of the method of the invention, the data processing device of each drive for performing the respective steps is a floating-point processor in floating-point format.

In accordance with an added aspect of the invention, there is provided a printing machine for performing a method of synchronizing a printing machine drive system, comprising drive motors operatable by respectively assigned drive control units via decentrally calculated drive values, data processing devices of local drive control units being connected so as to correspond with one another in a data network, drive values being calculatable based upon nominal values prescribed by a central operating and control unit by equivalent operations determined in the data network.

In accordance with an additional feature of the invention, the drive motors have a sampling device for registering operating values of the drive system, the sampling device being connected so as to communicate with the data processing devices, deviations of operating values, from nominal values prescribed by the central operating and control unit being determinable and being able to be compensated for by adapting the drive data.

In accordance with yet another feature of the invention, the deviations of operating values from nominal values are angular differences.

In accordance with yet a further feature of the invention, the data processing devices for calculating the drive data have at least one processor for determining the minimally required operations in the data network and for automatically performing at least one of the group of calculations and the adaptation of the local drive data by equivalent operations.

In accordance with a concomitant feature of the invention, the at least one processor is a floating-point processor.

Thus, according to the invention, a method is provided wherein a data processing device of a drive controller calculates the respective drive data as a function of the computing operations required in the remainder of the data processing device during the corresponding calculation of drive data for the other drives, system-induced differences between the drives being compensated for in the calculation.

It is therefore advantageously possible to operate the drive system completely decentrally and, as early as when calculating the drive data for the operation of the drive motor of each drive, to take into account differences between the various drives and to prescribe the drive data during the calculation. The data processing device preferably has, for this purpose, a standardized time base, which is mandatory for the entire system. In this case, the technical option is maintained of prescribing specific drive values centrally via the central operating and control unit.

Furthermore, all of the drives of a printing machine can be operated and driven in one drive system, so that it is to a great extent possible to dispense with subdividing the drives of a printing machine into individual drive groups. This and the decentralized calculation of drive values or movement trajectories, which can be implemented directly in the drives, lead to a rather low accumulation of data from the drive system and to being considerably capable of being implemented by standard components and correspondingly simple data processing programs for controllers and the data connections.

In particular, this achieves the situation wherein the data accumulation between the drive control units, between the drive control units and the central operating and control unit and, respectively, between the drive control units and the drive motors is reduced, so that the number of prescriptions of drive data can be increased. This leads to greater accuracy of the drive controllers and, therefore, of the synchronous running of the drive motors.

Further advantages result from the fact that the drive data can be processed free of formatting prescriptions of special components, such as user-definable integrated circuits or special data buses in the drive system, and therefore the data processing times can be reduced further. In addition, it is advantageous that the command and/or sampling times in each drive controller can be handled individually. The invention provides for the drive data to comprise desired values for each drive, and for the desired values to be calculated centrally by a nominal or desired value generator. Here, the nominal value generator can be associated with the central operating and control unit or with a drive control unit which is provided for the purpose, preferably integrated into the corresponding control unit. According to the invention, provision can further be made for the nominal value generator to be an external processor, which is associated with none of the aforementioned control units, calculates the desired values of the individual drives centrally and forwards them to the drives, it being possible for the respective nominal or desired values to be accepted by the drives without further calculations. This makes it possible for the drives which, for example, are controlled decentrally with respect to the sampling times, to have centrally calculated movement trajectories applied thereto.

According to the invention, provision is made for the drive data to comprise the position, the speed and/or the acceleration of the drive motor. By these parameters, the operation of the drive motor in every state can be described, so that synchronous running of the drive motors is prescribed at any time by the drive control units. This is achieved in that differences in the clock rate, the computing time and/or the computing accuracy of electronic components of the drive controllers, preferably of processors and memory units, are compensated for in the calculation. The compensation of differences during the calculations of these parameters can be performed by matching the calculations with one another with regard to the type or number of computing steps and also the storage of intermediate results. Here, the basis that is used is primarily not the production of the highest possible computing accuracy or a fast computing time, but the most identical computing accuracy or computing time possible during the calculation of the drive data for the various drives.

To this end, the invention proposes that the central operating and control unit transmit the nominal or desired values for the drive of the drive system to the drive control units, that the components of the data processing system of the drive control units calculate the drive data of the respectively associated drive, and that, in order to calculate the respective drive data, the components of the data processing system perform equivalent operations.

This advantageously reaches the situation wherein each drive has applied thereto drive data which are predetermined centrally but are calculated individually and decentrally for each drive. To this end, equivalent operations are performed by each drive controller, so that system-induced differences can be compensated for.

In this regard, the operations comprise, firstly, computing and storage operations, secondly, they also comprise data transfers, for example between the drive control units and drive motors, between the data processing devices, but also between the other electronic components of the drive system. During the calculation, it is readily possible for system-induced or production-induced parameters to be taken into account, such as transmission factors between the drives. The invention further provides that, in order to synchronize the drives, the operating values of each drive motor are registered decentrally by the associated local drive control unit, and that deviations of the operating values from the nominal or desired values prescribed by the central operating and control unit, preferably angular differences between the drive motors, are calculated by the data processing devices and compensated for by adapting the drive values.

Control of the operating values is in this case performed in the same way as the determination of the drive data. This is achieved in that the operations necessary to calculate and/or adapt the drive data of a drive are prescribed and/or are determined directly by the respective component of the data processing system by being connected together in a data network. Because, both during the calculation and during the adaptation of the drive data, the necessary operations are known, the operations to be carried out by the components of the data processing system can already be prescribed on the utilized part of the data processing programs or the integrated circuits. Provision is also made for the data processing system to determine the operations itself and to take them into account during the calculation or adaptation of the drive values.

To this end, the invention proposes that the information about necessary operations of the data processing system be distributed and compared in the data network, that the at least required identical operations be determined in the data network, and that the operations needed for each data processing device to calculate and/or adapt the drive data be modified so that, for each drive, the at least required operations be carried out during the calculation. It is thus advantageously possible to rule out differences in the calculations of the drive values of the various drives, such as different clock rates or computing accuracies of the processors.

It has proven to be advantageous for the necessary and/or at least required operations, respectively, to be determined by the component of the data processing system of the drive assigned thereto and/or by the central operating and control unit. In this regard, it is initially determined what operations of the respective component of the data processing system are needed in the calculations of the drive values. Provision is made for the operations to comprise storage steps and/or computing operations, preferably additions and/or multiplications. According to the invention, a determination is made as to which type of operations in what number are at least required for the calculations, in order to compensate for the differences.

According to the invention, this is achieved in that the same number of computing steps and/or storage steps are carried out by the component of the data processing system of each drive in order to calculate the drive data, preferably by floating-point processors in floating-point format. Carrying out the operations in floating-point format makes it possible to avoid normalization steps, which are expensive in terms of time and capacity, and at the same time to obtain equivalent computing accuracy in the calculations in each drive. Furthermore, it is therefore possible to reserve the same data processing programs for the calculations of the drive data in all of the drives, i.e., in each drive control unit, and therefore, on the software side, to create identical conditions. In this way, further differences in the calculation of the drive data are avoided.

According to the invention, the method is performed by a printing machine comprising drive motors which can be operated by respectively assigned drive control units by decentrally calculated drive values, the components of the data processing system of the local drive control units being connected to one another in a data network, the drive values being calculatable based upon the nominal or desired values prescribed by the central operating and control unit by equivalent operations determined in the data network.

For the control of the drives, the invention provides for the drive motors to have sampling devices for registering the operating values of the drive, for the sampling devices to be connected so as to communicate with the components of the data processing system, and for it to be possible for deviations of the operating values, preferably of the angular differences, from the nominal or desired values presribed by the central operating and control unit to be determined and compensated for by adapting the drive data.

To this end, provision is advantageously made for the data processing devices for calculating the drive data and/or the angular differences to have at least one processor, preferably a floating-point processor, which determines the at least required operations in the data network and automatically performs the calculations and/or adaptation of the local drive data by equivalent operations.

With the printing machine thus described, it is advantageously possible at any time to achieve identical command prescriptions within the context of the selected accuracy and to come to identical changes in the triple values comprising the acceleration, the speed and the position of the drive motor of the relevant drives, for example of the feeder, the printing unit with main drive and the delivery of the printing machine. Deviations from synchronous running are therefore avoided, particularly when the operating values of the acceleration, the rotational speed and the position of the drive motors are no longer comparable due to system-induced limits of conventional synchronous controls.

Other features which are considered as characteristic for the invention are set forth in the appended claims.

Although the invention is illustrated and described herein as embodied in a printing-machine drive system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single figure of the drawing, wherein:

DESCRIPTION OF THE PREFERRED EMBODIMENTS

Figure 1:
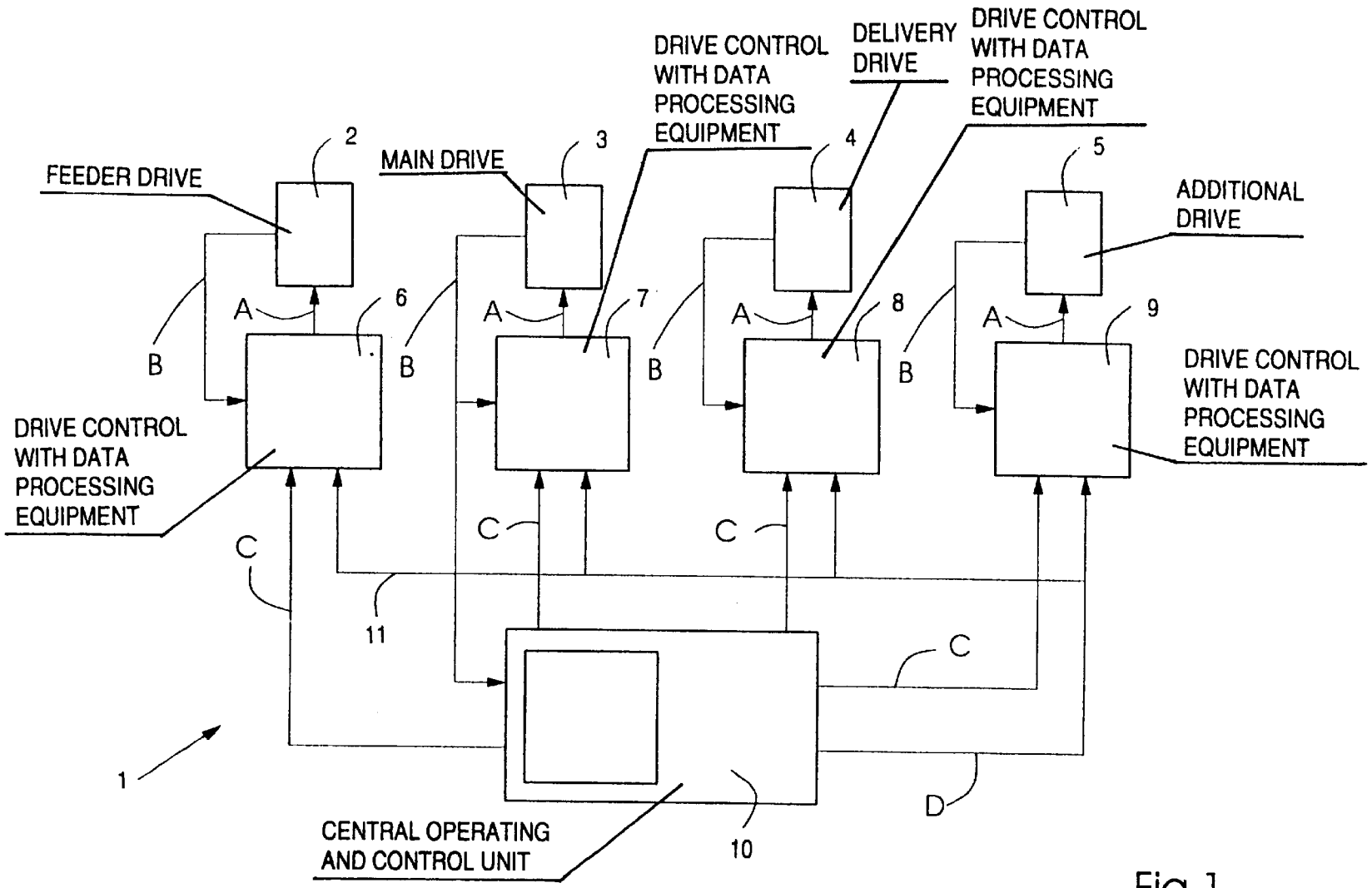
FIG. 1 is a schematic diagram of a printing-machine drive system with a plurality of drives, which is constructed in accordance with the invention and which serves for performing the method of the invention.

Referring now to the single figure, namely FIG. 1, of the drawing, there is shown therein a printing-machine drive system 1 having four mutually independent drives, namely a feeder drive 2, a main drive 3, a delivery drive 4 and an additional drive 5, respectively. The drives 2, 3, 4 and 5, respectively, have drive motors, each drive motor having a local drive control unit 6, 7, 8 and 9, respectively, with a component of a data processing system assigned thereto. The drive control units 6, 7, 8 and 9 and a central operating and control unit 10 are connected so as to communicate with one another in a data network 11. The drive motors are operated decentrally, by the respectively associated drive control units 6, 7, 8 and 9, by prescribed drive data, which are represented in the drawing by the arrows A. For this purpose, the drive control units 6, 7, 8 and 9 automatically calculate the movement trajectories for the respective drive motor. In this regard, the values for the position, the speed and the acceleration are calculated decentrally and transmitted to the drive motor. The general prescription of the desired or nominal values, which is illustrated in the drawing by arrows C, is provided by the central operating and control unit 10, as is the clocking, which is illustrated in the drawing by the arrow D.

Because of the different specifications of the various drives 2, 3, 4 and 5, the respective drive control units 6, 7, 8 and 9 have to perform various computing operations, which additionally are performed by different operations of the data processing system. For this purpose, the drive control units 6, 7, 8 and 9, respectively, preferably have floating-point processors, which are generally integrated in the microprocessors of the data processing system.

In order to calculate the drive data, the operating values, preferably the position, the speed and the acceleration of the drive motors, are determined and registered by the respective components of the data processing system, which is illustrated in the drawing by the arrows B. The prescription of the drive data and the determination of the operating values on the drive motors are performed on the drives at different sampling times.

In order to avoid any necessity for performing the required computing steps more frequently by the data processing system components with shorter sampling time intervals than by the data processing system components with longer sampling time intervals, which, after a given number of computing cycles, because of the finite mantissa in the calculation in a floating-point format, leads to divergences in the drive data, according to the invention, the calculations are carried out in a manner that the data processing system component of one drive controller calculates the respective drive data as a function of the computing operations required in the remaining data processing system components in accordance with the calculations of drive data for the other drives, and that system-induced differences between the drives are compensated for in the calculation. The result thereof is that the system with the longer sampling time intervals carries out the same number of computing steps, also with exactly the same sampling clock rate, as the system with the shorter sampling time intervals. In this regard, an equidistant time interval is prescribed, which corresponds to the smallest common multiple of all the relevant sampling times of the drives. Advantageously achieved thereby is that all of the drives, assuming an identical starting state and assuming an identical prescription of operating steps, have identical desired or nominal values at any instant of time, which corresponds to the smallest common multiple of all the sampling times, so that all of the drives run synchronously for a very long time.

The implementation of the desired or nominal value calculation in the printing machine according to the invention is such that, at the beginning of a move command, the starting values are stored and, sampling step by sampling step, only the difference to be moved is calculated, because, during operation, virtually no acceleration is to be calculated. Also, for different starting conditions, however, identical command prescriptions are thus assured which are identical with difference values to be moved. The difference values to be moved are in turn accumulated sampling step by sampling step, so that the respective sampling-conforming desired or nominal value results from the sum of the starting value at the beginning of the command and the accumulated difference value to be moved. The possible deviations in the synchronous running of the drives therefore advantageously depend exclusively upon the deviations of the starting values. Consequently, at any instant of time corresponding to a multiple of the smallest common multiples of all the sampling times, assuming identical command prescriptions, identical difference values to be moved are also calculated. Optimum synchronous running of the drives is thereby assured.

A possibility for adapting the operations is to increase the sampling time for the systems with shorter sampling time intervals. In this regard, the data processing system carries out identical or equivalent operations, which are processed by floating-point processors in the drive control units 6, 7, 8 and 9. For mathematical operations which include more than just one operation, a compiler holds intermediate results in the registers of the floating-point processor within the context of the optimization stage that is used. The intermediate results from each operation, depending upon the floating-point processor, are, in this regard, not processed further in the selected numerical format.

For the data processing system, floating-point processors are provided which, as a standard, operate in the 80-bit format. In order to avoid rounding errors from occurring during each intermediate storage operation, those errors tending to accumulate over a number of operations and being undetectable in the originally selected format which, for example, operates singly or doubly exactly in accordance with IEEE 754, identical or equivalent intermediate storage operations are prescribed or determined for each drive. The calculation of the drive data is then carried out with equivalent operating steps, so that at least the same error rate occurs in each drive 2, 3, 4, 5. In the statistical average of the frequency of the operations or operating steps, the errors at least approximately balance out, so that the drives can be driven and operated at least approximately in synchronism with one another.

I claim:

1. A method of synchronizing a printing-machine drive system having a plurality of drives with drive motors, the method which comprises:

assigning to the drives local drive control units and a central operating and control unit with a data processing system having components connected to communicate with one another;

operating the drive motors decentrally by prescribed drive data via the respectively assigned drive control units;

calculating, with at least one of the components of the data processing system of one of the drive control units, respective drive data in dependence on computing operations required in other components of the data processing system; and compensating, in a resulting calculation, for one of system-induced differences between the drives and system-induced differences between the components of the data processing system.

2. The method according to claim 1, which further comprises providing nominal values for the drive data for each of the drives, and centrally calculating the nominal values by a nominal value generator.

3. The method according to claim 1, which further comprises providing the drive data as at least one of the values selected from the group thereof consisting of a position, speed and acceleration of the drive motor.

4. The method according to claim 3, which further comprises providing the compensation in the calculation for differences in at least one of clock rate, computing time and computing accuracy of electronic components of drive controls.

5. The method according to claim 4, wherein the components of the controls are selected from the group consisting of processors and memory units.

6. The method according to claim 4, which further comprises, by the central operating and control unit, transmitting nominal values for the drive of the drive system to the drive control units, by the respective components of the data processing system of the drive control units, calculating the respective drive data of the respectively assigned drive, and, by the data processing system, performing equivalent operations in order to calculate the respective drive data.

7. The method according to claim 6, which further comprises, in order to synchronize the drives, decentrally registering the operating values of each drive motor by the assigned local drive control unit, and calculating, by the data processing system, deviations of the operating values from the nominal values prescribed by the central operating and control unit, and adapting the drive values to compensate therefor.

8. The method according to claim 6, wherein the deviations of the operating values from the nominal values calculated by the data processing system are angular differences between the drive motors.

9. The method according to claim 6, which further comprises providing at least one of the operations necessary for calculating and adapting the drive data of a drive by at least one of prescribing it and determining it directly by an interlocking connection in a data network by the data processing system.

10. The method according to claim 9, which further comprises distributing and comparing information about necessary operations of the data processing system in the data network, determining the minimally required identical operations in the data network, and modifying the operations required for each component of the data processing system for at least one of calculating and adapting the drive data in a manner that, for each drive, the minimally required operations are performed during the calculation.

11. The method according to claim 10, which further comprises determining at least one of the necessary and the minimally required operations, respectively, by at least one of the data processing system of at least one of the assigned drives and the central operating and control unit.

12. The method according to claim 11, which further comprises providing the operations as at least one set of steps selected from the group thereof consisting of storage steps and computing steps.

13. The method according to claim 12, wherein the computing steps are selected from the groups thereof consisting of additions and multiplications.

14. The method according to claim 1, which further comprises performing the same number of steps selected from the groups thereof consisting of computing steps and storage steps by the data processing component of each drive in order to calculate the drive data.

15. The method according to claim 14, wherein the data processing component of each drive for performing the respective steps is a floating-point processor in floating-point format.

16. A printing machine with a synchronized drive system, comprising:

drive motors;

drive control units respectively assigned to said drive motors for operating said drive motors via decentrally calculated drive values;

local drive control units having data processing devices connected so as to cmmunicate with one another in a data network; and a central operating and control unit prescribing nominal values for calculating drive values by equivalent operations determined in said data network.

17. The printing machine according to claim 16, wherein said drive motors have a sampling device for registering operating values of said drive system, said sampling device being connected so as to communicate with said data processing devices, deviations of operating values, from nominal values prescribed by said central operating and control unit being determinable and being able to be compensated for by adapting the drive data.

18. The printing machine according to claim 17, wherein said deviations of operating values from nominal values are angular differences.

19. The printing machine according to claim 16, wherein said data processing devices for calculating the drive data have at least one processor for determining the minimally required operations in the data network and for automatically performing at least one of the group of calculations and the adaptation of the local drive data by equivalent operations.

20. The printing machine according to claim 19, wherein said at least one processor is a floating-point processor.

* * * * *